United States Patent [19]

Huon de Kermadec

[11] Patent Number: 4,512,259

[45] Date of Patent: Apr. 23, 1985

[54] AUTOMATIC TRANSPORT SYSTEM COMPRISING CABLE-DRAWN NON-MOTORIZED VEHICLES

[75] Inventor: Jean Huon de Kermadec, Versailles, France

[73] Assignee: Soule Fer et Froid S.A., Bagneres de Bigorre, France

[21] Appl. No.: 583,277

[22] PCT Filed: Feb. 9, 1981

[86] PCT No.: PCT/FR81/00015

§ 371 Date: Oct. 6, 1981

§ 102(e) Date: Oct. 6, 1981

[87] PCT Pub. No.: WO81/02275

PCT Pub. Date: Aug. 20, 1981

Related U.S. Application Data

[63] Continuation of Ser. No. 309,888, Oct. 6, 1981, abandoned.

[30] Foreign Application Priority Data

Feb. 11, 1980 [FR] France ..... 80 02908

[51] Int. Cl.[3] ..... B61B 9/00; B61B 12/12

[52] U.S. Cl. ..... 104/208; 104/173 R; 104/211; 104/226; 104/231; 188/83; 188/166

[58] Field of Search ..... 104/165, 173 R, 178, 104/208, 211, 224, 226, 229, 231, 232, 234, 204; 74/209; 188/83, 166, 167; 198/334, 792

[56] References Cited

U.S. PATENT DOCUMENTS

| | | | |
|---|---|---|---|
| 381,032 | 4/1888 | Roe | 104/226 |
| 492,248 | 2/1893 | Walsh | 104/229 |
| 536,425 | 3/1895 | Hachenberg | 104/234 |
| 3,142,263 | 7/1964 | Craft | 104/229 X |
| 3,871,303 | 2/1974 | Woodling | 104/173 R |
| 4,048,923 | 9/1977 | Giraud | 104/165 X |

FOREIGN PATENT DOCUMENTS

| | | | |
|---|---|---|---|
| 62673 | 4/1971 | Australia . | |
| 40927 | 10/1973 | Australia . | |
| 50196 | 6/1974 | Australia . | |
| 62194 | 5/1975 | Australia . | |
| 25909 | 10/1906 | Austria | 104/208 |
| 28155 | 12/1882 | Fed. Rep. of Germany . | |
| 28307 | 10/1883 | Fed. Rep. of Germany . | |
| 69650 | 12/1892 | Fed. Rep. of Germany . | |
| 2173372 | 5/1973 | France . | |
| 2265591 | 10/1975 | France . | |
| 2272923 | 12/1975 | France . | |
| 0018932 | 11/1980 | France . | |
| 5005 | of 1882 | United Kingdom | 104/229 |
| 18578 | of 1894 | United Kingdom | 104/229 |

*Primary Examiner*—Randolph Reese
*Attorney, Agent, or Firm*—Spencer & Frank

[57] ABSTRACT

A transport system comprising cable-drawn non-motorized vehicles guided independently of the cable and coupled to and uncoupled from the cable automatically. The vehicle comprises a progressively engaged clamp gripping a cable, a braked wheel, and support and guide wheels bearing on rails. The clamp is controlled by a cam which is fixed relative to the track and, through the joint action of the respective cable and vehicle guide systems, grips the cable.

14 Claims, 16 Drawing Figures

AUTOMATIC TRANSPORT SYSTEM COMPRISING CABLE-DRAWN NON-MOTORIZED VEHICLES

This application is a continuation of application Ser. No. 06/309,888, filed Oct. 6th, 1981 now abandoned.

BACKGROUND OF THE INVENTION

The present invention relates to systems for transporting passengers or materials by means of cable-drawn non-motorized vehicles, these systems having the following characteristics:

the vehicles are supported and guided by a track specifically for this purpose and not by the cable;

the vehicles may be coupled and uncoupled from a cable moving at constant speed, to slow down or stop at a station, for example.

Some 100 years ago the first systems of this type replaced animal traction on tramways and were used for certain underground railways (Glasgow). Most such systems have disappeared with advances in electric traction, and the San Francisco cable car is perhaps the only system of this type still in operation. Its operation is extremely simple, as disclosed in German Pat. No. 28155.

The vehicles are guided by rails laid on the ground and entrained by a cable moving at constant speed. When the driver wishes to stop at a station he opens the clamp which couples the vehicle to the cable and brakes the vehicle wheels. To depart, the clamp grips the cable and the vehicle gradually accelerates to the speed of the cable. The progressive coupling action is obtained either by friction between the jaws of the clamp and the cable or by braking pulleys which replace such jaws and which roll without slip on the cable. Various mechanisms of this type are disclosed in French Pat. Nos. 695425, 1359331 and 1554769, and in German Pat. No. 532,413.

Since the end of the sixties increasing traffic congestion in towns has led to increasing research on urban transport systems using small automatic vehicles. Cable traction systems have again become relevant and offer two major advantages for small vehicle systems:

relatively simple automatic control facilities since there is no risk of vehicles coupled to the same cable colliding between stations;

low energy consumption due to the low weight of the non-motorized vehicles.

The most advanced of this new generation of automatic transport systems using cable-drawn vehicles would seem to be that disclosed in French Pat. No. FR 71 12413. Vehicles guided by rails laid on the ground are coupled to the high-speed cable by means of a conventional clamp with jaws. The coupling action is instantaneous as relative slip between the clamp and cable is virtually impossible. If the speed of a vehicle is slightly different from that of the cable at the moment the vehicle couples on to the cable, the vehicle cannot absorb this speed difference by swinging, like the suspended cabins of cable railways, and the sudden shock may be violent in intensity. Passenger safety therefore calls for strict synchronization of the vehicle and cable speeds at the moment of coupling. Automatic control of the coupling action in association with such synchronism would seem to be a difficult problem, especially in the case of vehicles following one after the other at short intervals.

SUMMARY OF THE INVENTION

The object of the present invention is to provide an automatic transport system using cable-drawn vehicles which is of simple and economic construction and which offers the possibility of a short interval between vehicles (10 seconds, for example) with no risk of shock on coupling a vehicle to the cable. According to the invention this is achieved by the following combination of known mechanisms:

the reversible coupling of the vehicles to the cable by means of two-branch clamps comprising a "fixed" part connected to the chassis of the vehicle, a "moving" part which is connected to the fixed part and which rolls without slip on the cable and, in at least one branch, a device for resisting relative movement between the fixed and moving parts;

the provision at each end of a section of the track in which the vehicles are drawn by a cable of an actuating device which co-operates with a device controlling the clamp so as to close the clamp on entry to and open the clamp on exit from said section;

the provision at the entry end of a section of the track in which the vehicles are drawn by a cable of a device for bringing the clamp on the vehicle and the cable into closer proximity with one another.

Maintaining the required spacing of vehicles and passenger comfort (where applicable) requires that the vehicles be accelerated relatively accurately when synchronizing their speed with that of the cable. In accordance with an important characteristic of the invention this accuracy is achieved by slaving the braking force to the mass of the vehicle, by means of a weighing mechanism.

Further and complementary characteristics of the invention will emerge from the following description of embodiments thereof, in particular:

a clamp in which the braking device is operated by closing the clamp, a "coil-type" weighing mechanism.

DESCRIPTION OF THE PREFERRED EMBODIMENTS

Figure 2:
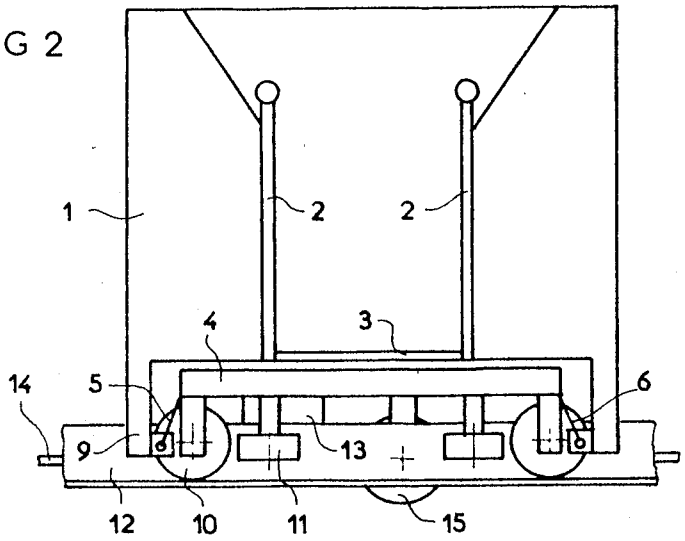
FIG. 2 is a corresponding elevation as seen from the lefthand side in FIG. 1.
Figure 1:
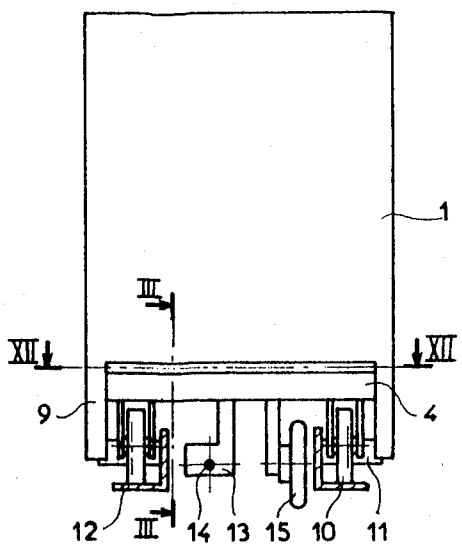
FIG. 1 is a transverse cross-section through a vehicle on its guiding track.

Referring first to FIGS. 1 and 2, note that the vehicle comprises a body 1 for accommodating passengers, the opening in which is defined by two uprights 2 and a floor 3. The body 1 is suspended from a chassis 4 by cables 5, 6 attached to suspension posts 9. The chassis 4 carries the units which support, guide and drive the vehicle, in the form of four vertical wheels 10 and four horizontal wheels 11 which bear on rails 12, a clamp 13 gripping a cable 14 and a "braked wheel" 15.

Figure 3:
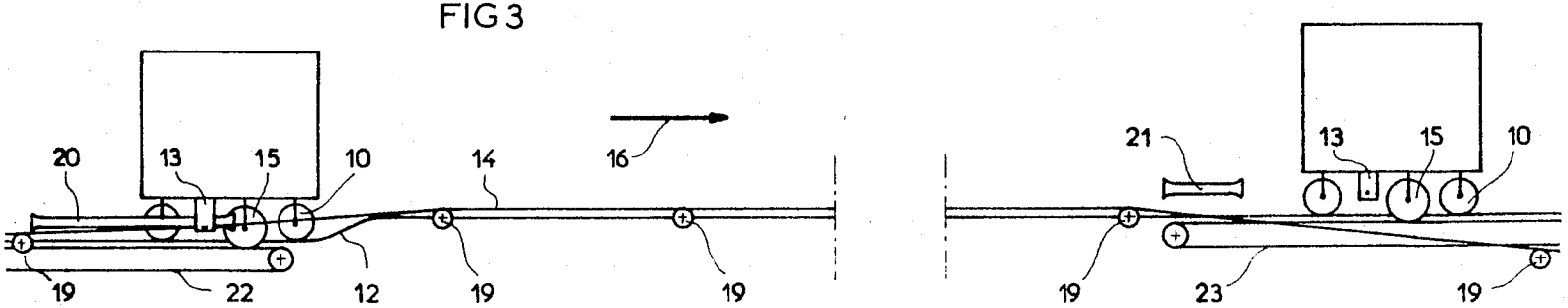
FIG. 3 is a schematic view of the track shown in cross-section on the line III—III in FIG. 1, showing vehicle coupling and decoupling sections.

FIG. 3 shows in highly schematic fashion how vehicles are entrained by the cable between stations and in the coupling section (in which the vehicle is coupled to the cable) and the decoupling section (in which the vehicle is uncoupled from the cable). The direction of movement of the vehicles is indicated by the arrow 16. On the track are the cable 14 guided by rollers 19, the rail 12 (only that part supporting wheels 10 is shown, to avoid over-complication of the Figure), a coupling cam 20, a decoupling cam 21 and two transporter or drive belts 22 and 23.

The system operates as follows: the vehicle approaching from the left is entrained at the exit from the station by belt 22 engaging braked wheel 15. When clamp 13 arrives at coupling cam 20 which is fixed relative to the track this cam causes clamp 13 to open. In the section in which cam 20 holds clamp 13 open the vehicle guided by rail 12 moves horizontally. In contrast, cable 14 guided by rollers 19 rises progressively. Before the end of cam 20 cable 14 reaches its highest point within the clamp. When clamp 13 reaches the end of cam 20 it closes on the cable which entrains the vehicle to the next station. The vehicle disengages from belt 22 and is raised slightly by a sloped section of rail 12 so as to pass over rollers 19.

The decoupling action when the vehicle arrives at the next station is similar to the coupling action. Braked wheel 15 contacts drive belt 23. Clamp 13 engages decoupling cam 21 which opens it. The vehicle guided by rails 12 continues to move horizontally whereas the cable guided by rollers 19 drops progressively. When clamp 13 reaches the end of cam 21 it closes above the cable and the vehicle continues in motion entrained by belt 23.

By virtue of the respective vehicle and cable drive systems, the vehicle clamp trajectory passes above guide rollers 19. This explains why the cable, which is otherwise supported on these rollers, is momentarily lifted off when a vehicle passes. This arrangement facilitates decoupling since the cable tends to escape from the clamp as soon as it is opened. On the other hand, it complicates coupling as the clamp must successively descend relative to the cable, passing below the level of the cable, close and then rise with the cable so as to pass over rollers 19.

In accordance with an important characteristic of the invention, automatic operation of the system requires the provision of a device for bringing the clamp of the vehicle being coupled on and the cable into closer proximity with one another. This requirement is met by the previously described organization of the vehicle and cable guide systems. Other methods known per se may be used instead, for example:

raising the cable momentarily by means of a roller attached to the track or to the vehicle;

momentarily lowering the clamp, which is pivoted to the vehicle, under the control of a device fixed to the track.

Figure 4:
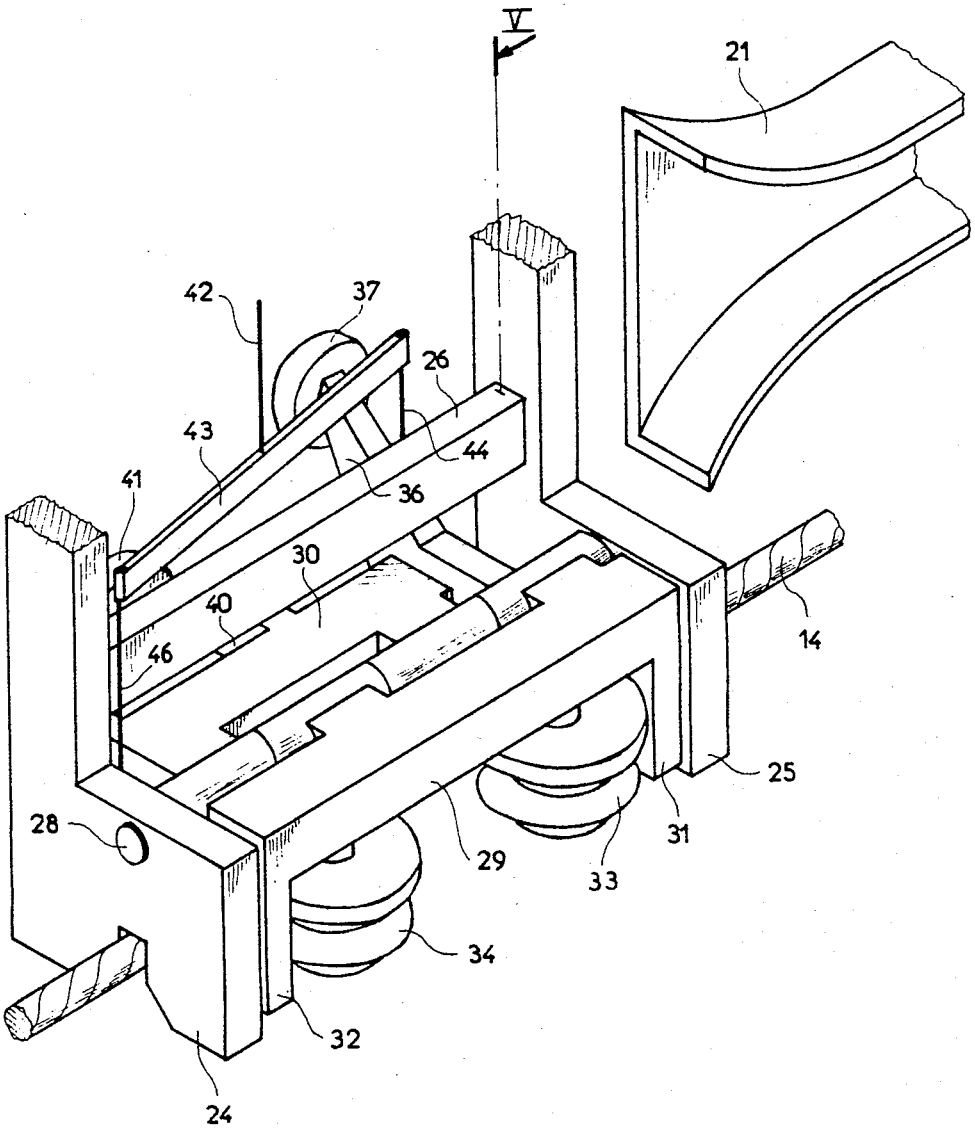
FIG. 4 is a perspective view of a "braked pulley" clamp and an actuating device.
Figure 5:
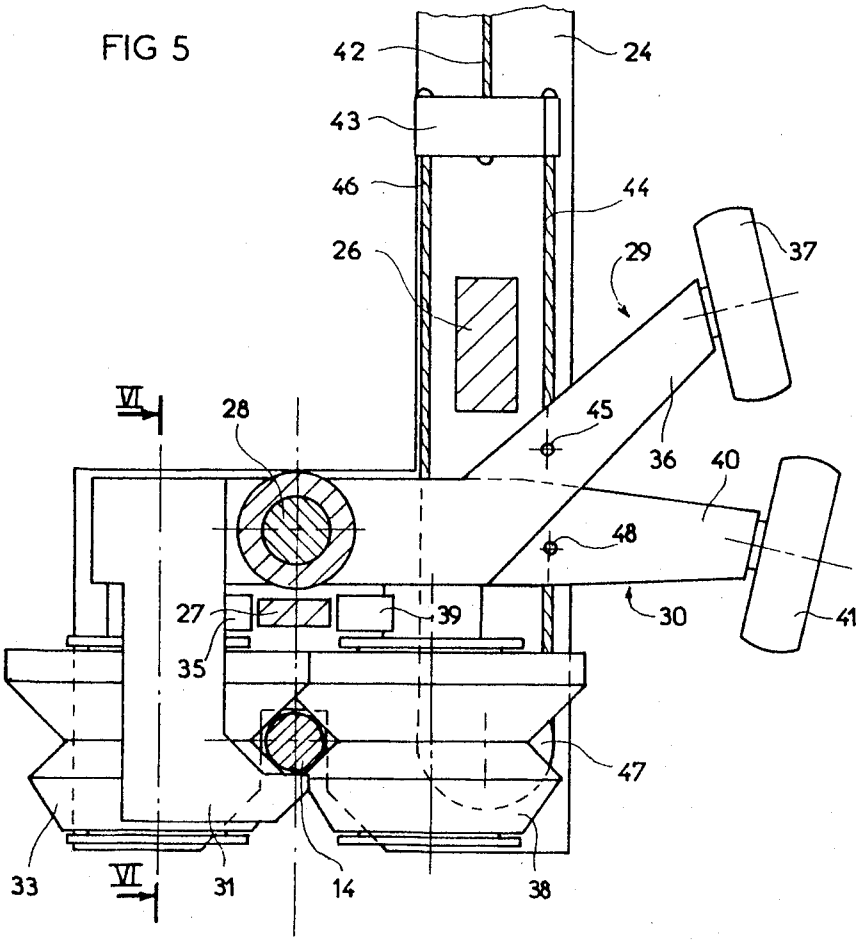
FIG. 5 is a cross-section through this clamp on arrow V in FIG. 4.

Referring to FIGS. 4 and 5, the clamp comprises two flanges 24, 25 acting as guides linked by two cross-members 26, 27. These guides 24, 25 are attached beneath the chassis of a vehicle (not shown) and support a shaft 28 on which are pivoted two jaws 29, 30. Jaw 29 comprises two support arms 31, 32, two braked pulleys 33, 34, an end stop 35, an opener arm 36 and an opener roller 37. Jaw 30 comprises a braked pulley 38, an end stop 39, an opener arm 40 and an opener roller 41. A cable 42 is coupled to a rocking lever 43 which distributes the clamping force between jaws 29 and 30. A cable 44 is attached to jaw 29 by means of a pin 45. A cable 46 passes around a pulley 47 and is attached to jaw 30 by means of a pin 48. The decoupling cam 21 is shown in FIG. 4.

Figure 6:
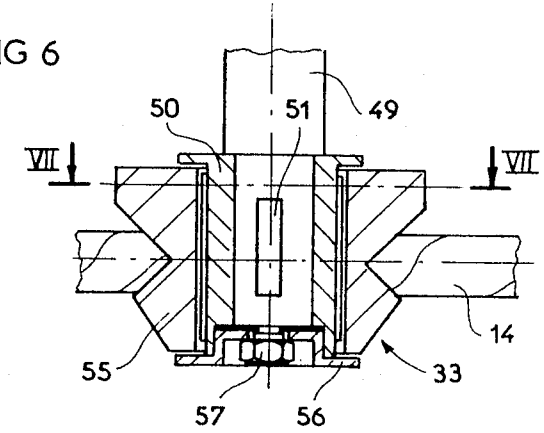
FIG. 6 is a detail cross-section on line VI—VI in FIG. 5.
Figure 7:
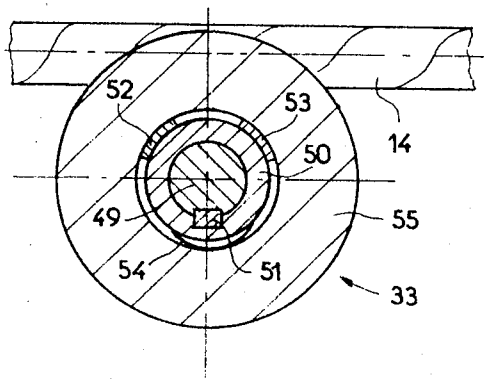
FIG. 7 is a detail cross-section on line VII—VII in FIG. 6.

FIGS. 6 and 7 show the construction of braked pulley 33 in more detail. It comprises a shaft 49 keyed to a sleeve 50 by means of a key 51, two friction linings 52, 53, a leaf spring 54, an outer ring 55 and a flange 56 retained by a nut 57. The other pulleys 34, 38 are of similar construction.

Figure 13:
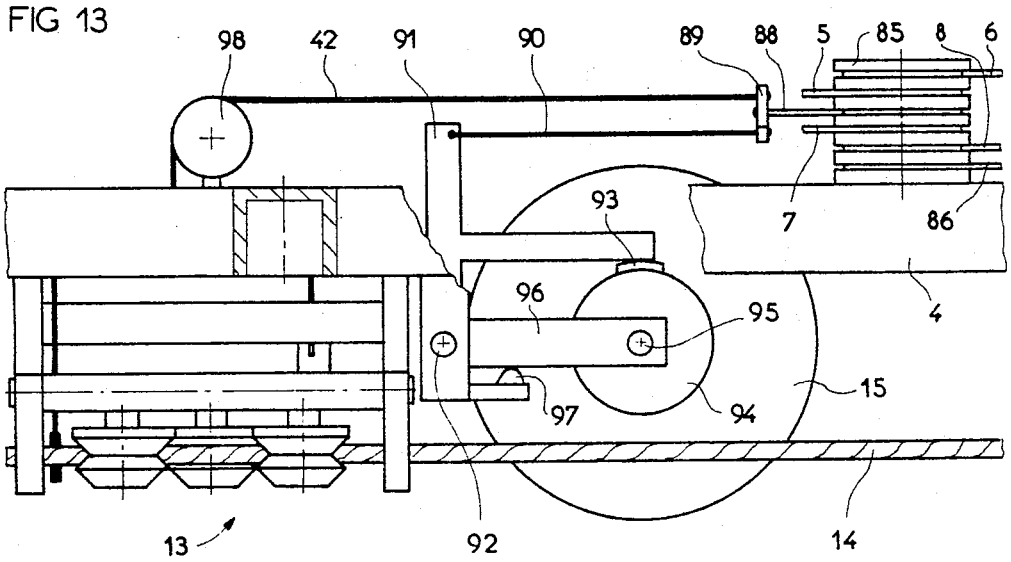
FIG. 13 is a cross-section on line XIII—XIII in FIG. 12, to a larger scale and showing the mechanism controlling a clamp and a braked wheel.
Figure 12:
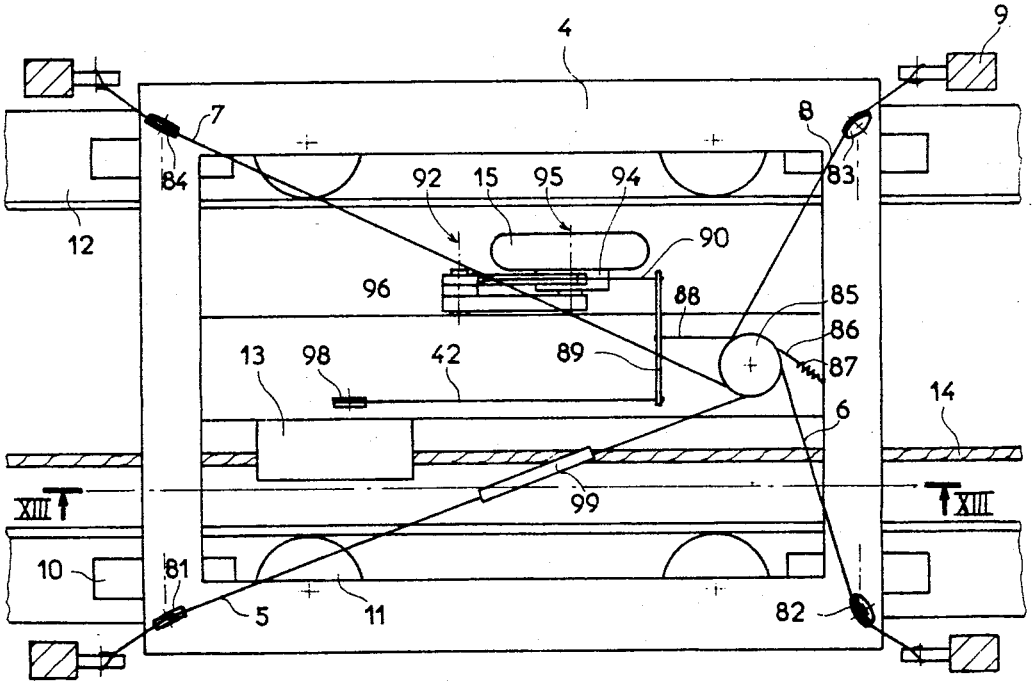
FIG. 12 is a cross-section on line XII—XII in FIG. 1 to a larger scale.

Under normal operating conditions when the vehicle is being drawn by a cable the clamp in accordance with the invention maintains the vehicle in a fixed position relative to the cable in the same way as conventional clamps. The clamping force, which is made proportional to the total mass of the vehicle by means of a weighing system to be described with reference to FIGS. 12 and 13, is exerted continuously on jaws 29 and 30 pivoted on shaft 28.

Braked pulleys 33, 34 and 38 are attached to the jaws by their shafts 49. The moving part of the pulley is outer ring 55 which, when the clamp is gripping the cable, is maintained by the action of leaf spring 54 and cable 14 against linings 52 and 53. Ring 55 features slight axial play between sleeve 50 and flange 56. The torque required to rotate these braked pulleys, and thus to move the vehicle relative to the cable, is proportional to the clamping force and thus to the total mass of the vehicle. Thus the drive cable cannot produce vehicle acceleration above a predetermined value, thereby minimizing shock. Moreover, to eliminate all risk of the braked pulleys slipping on the cable the force of adhesion between cable 14 and ring 55 is made significantly greater than that between ring 55 and linings 52, 53, by means of appropriate design features such as judicious selection of cable-pulley and ring-lining coefficients of friction, pulley groove shape, cable-pulley axis and lining-pulley axis separation.

Cable 14 is accurately positioned within the clamp, being trapped with slight play in a substantially square "window" of which support arms 31, 32 form the bottom edge and guides 24, 25 form the other three edges. Lateral displacement of the cable within this window is permitted by rotation of jaws 29 and 30. Vertical displacement is permitted by axial movement of braked pulleys 33, 34, 38.

In curves and over humps the clamp moves the cable away from its guide pulleys as the vehicle passes. This is the conventional method as used on funicular railways. In curves the cable bears on guides 24, 25. In the case of humps the cable bears on support arms 31, 32. Thus the force exerted on the cable by braked pulleys 33, 34, 38 does not vary in curves and over humps.

Relative slip between the vehicle and cable can in practice occur only when the vehicle is being coupled to or decoupled from the cable. In these sections, in which the cable run is usually straight, the force with which the cable bears on the sides of the window is small. However, the window may be defined by freely rotating rollers, rather than by rubbing surfaces.

In order to engage the cable, rollers 37, 41 bear and roll on cam 20 (similar to cam 21) to move braked pulleys 33, 34, 38 apart. As described with reference to FIG. 3, cable 14 rises relative to the vehicle, through the joint action of their respective guide systems. Cable 14 moves to its highest position between guides 24, 25. Cam 20 acting on rollers 37, 41 can then permit the jaws to close again.

The operation of jaws 29, 30 is similar on decoupling the vehicle from the cable. Guides 24, 25 guarantee disengagement of the cable from braked pulleys 33, 34, 38 on opening of jaws 29, 30. Cable 14 is drawn downwards by the joint action of the cable and vehicle guide systems and when it has escaped from the clamp the jaws may be held open until the next drive cable is reached or closed, with end stops 35, 39 contacting cross-member 27.

The clamp in accordance with the invention has been described with reference to a device for progressively coupling to the cable. A clamp of this type may also be used to implement speed variations, with the vehicle coupling onto a faster cable to accelerate or a slower cable to decelerate.

The clamp described with reference to FIGS. 4 and 5 comprises three braked pulleys. This number is obviously not mandatory and may vary from one to a number limited only by the length of the vehicle. Increasing the number of braked pulleys disposed on the jaws symmetrically relative to the cable or alternately as in FIGS. 4 and 5 provides the facility for limiting the force transmitted by each braked pulley and the angle subtended by the cable at each pulley.

FIGS. 8 to 11 show an alternative "braked caterpillar track" embodiment of the clamp in accordance with the invention. These caterpillar tracks replace braked pulleys 33, 34, 38 in FIGS. 4 to 7.

Figure 8:
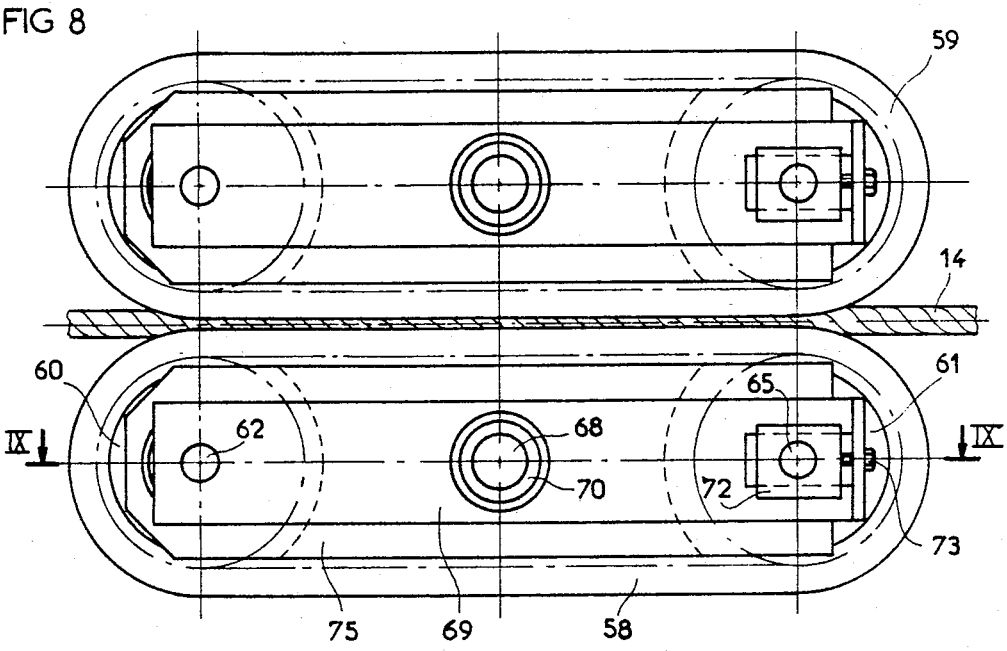
FIG. 8 is a view from below of a "braked caterpillar track" clamp gripping a drive cable.
Figure 9:
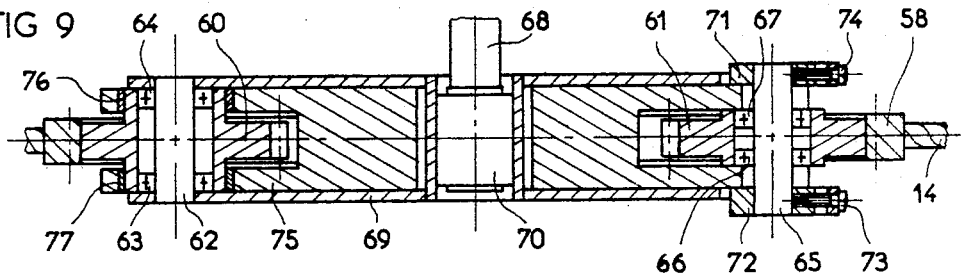
FIG. 9 is a cross-section on line IX—IX in FIG. 8.

FIGS. 8 and 9 show cable 14 in contact with two caterpillar tracks 58, 59. The two caterpillar tracks 58, 59 are identical and the following description therefore refers only to caterpillar track 58. It runs on two sprockets 60 and 61. Sprocket 60 is mounted on a shaft 62 with bearings 63, 64. Similarly, sprocket 61 is mounted on a shaft 65 with bearings 66, 67. A shaft 68 is mounted on jaw 29 (not shown), like shaft 49 of braked pulley 13 as shown in FIGS. 6 and 7, this shaft 68 being mounted on a support 69 through a resilient articulation 70 comprising two concentric metal tubes joined together by an elastomer material conferring the elasticity of the articulation.

Shafts 62 and 65 are connected to support 69, shaft 62 directly and shaft 65 through the intermediary of two sliding blocks 71, 72, the positions of which are adjusted by screws 73, 74. A sole plate 75 which guides the caterpillar track between sprockets 60, 61 is in contact with sprocket 60 on one side through linings 76, 77 and in contact with shaft 65 on the other side.

Figure 10:
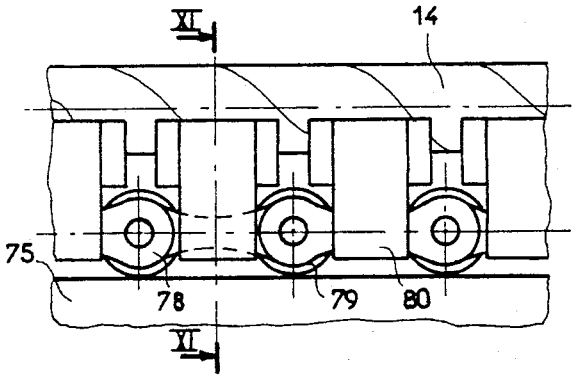
FIG. 10 is a view to a larger scale of part of FIG. 8.
Figure 11:
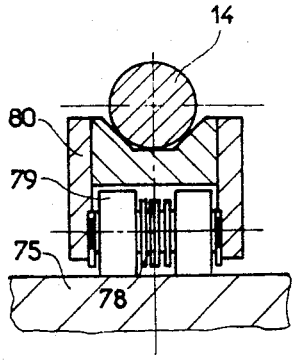
FIG. 11 is a cross-section on line XI—XI in FIG. 10.

FIGS. 10 and 11 show the construction of caterpillar track 58 and its position between cable 14 and sole plate 75 in more detail than FIGS. 8 and 9.

Caterpillar track 58 comprises a double chain 78 with rollers 79, its links carrying stirrups 80 in contact with cable 14. Rollers 79 are in contact with sole plate 75.

The operation of the braked caterpillar track clamp as shown in FIGS. 8 to 11 is identical to that of the braked pulley clamp as shown in FIGS. 4 to 7. The clamping force of the jaw carrying shaft 68 is transmitted to the cable in the following manner: shaft 68 transmits this force to support 69 which distributes it between shafts 62 and 65. Shaft 65 transmits force directly to sole plate 75 and shaft 62 transmits force through the intermediary of sprocket 60. The sole plate transmits the total force to caterpillar track 58 which in turns transmits it to the cable.

When the caterpillar track is moving, the resisting torque on braked sprocket 60 is thus proportional to the jaw clamping force, as with the braked pulleys. Friction between caterpillar track 58 and sole plate 75 is low, due to the use of rollers 79.

The mounting of shaft 68 in resilient articulation 70 permits slight skewing of caterpillar track 58 relative to the jaw, to ensure good contact between cable 14 and caterpillar track 58.

The slack in caterpillar track 58 is adjusted by screws 73, 74 which move shaft 65 through the intermediary of sliding blocks 71, 72. A conventional locking device (not shown) then immobilizes the movable assembly on support 69.

Without departing from the scope of the invention it is possible to conceive of other embodiments of the braked caterpillar track clamp in which the braking, slack adjustment and articulation actions are implemented differently. While all "braked caterpillar track" embodiments will doubtless be more complex than "braked pulley" embodiments, they do eliminate the curvature of the cable which results with braked pulley systems in which the pulleys are arranged on alternate sides of the cable along its length.

For the two types of embodiment previously described (braked pulley and braked caterpillar track clamp) the force with which the moving part of the clamp (ring 55 in FIG. 6 and caterpillar track 58 in FIG. 8, for example) adheres to the cable is proportional to the jaw clamping force. The force resisting relative movement of the moving part of the clamp relative to its fixed part (friction linings 52, 53 in FIG. 6 and 76, 77 in FIG. 8, for example) is also proportional to the jaw clamping force.

For certain applications, and in particular for transportation of passengers, where the total mass of the vehicle may vary considerably (by a factor of 4 between empty and fully-laden vehicles, for example), it is preferable for the braking force (and thus the jaw clamping force) to be made proportional to the total mass of the vehicle by means of a weighing system.

Many weighing mechanisms exist. In view of specific constraints, in particular the opening of the jaws by means fixed on the track, it would seem preferable to use the weighing mechanism described with reference to FIGS. 12 and 13.

In this embodiment, body 1 is suspended from chassis 4 on posts 9 by means of four cables or ties 5 to 8 (FIGS. 1, 2). These cables pass over respective pulleys 81 to 84 and each is coupled to a common weighing coil or spool member 85. Also coupled to this coil is a cable or tie 86 tensioned by a tare spring 87 and a cable 88 attached to a rocking lever 89 connected to clamp control cable 42 (FIG. 4) and to a cable 90 controlling braked wheel 15. Cable 42 passes around a pulley 98. Cable 90 acts on a lever 91 pivoted to chassis 4 on a shaft 92 and carrying a brake pad 93 aligned with a brake drum 94 on wheel 15. Braked wheel 15 is mounted on a shaft 95 carried by an arm 96 which pivots on spindle 92. Arm 96 bears on a stop 97 attached to chassis 4 when braked wheel 15 is not bearing on a transporter belt 22, 23.

In accordance with one characteristic of the invention, the benefit of this articulated mounting of the braked wheel on chassis 4 is due to the fact that the braked wheel is urged against belts 22, 23 with a force which is substantially proportional to the total mass of the vehicle, as is the braking force on the wheel. The arrangement described above thus makes the one force conditional on the other, so guaranteeing that braked wheel 15 will roll without slip on belts 22, 23 irrespective of the load, the position of the load and the suspension of the vehicle chassis. This facility cannot be provided if the shaft of braked wheel 15 is attached directly to chassis 4, which already comprises four supporting wheels 10. On the other hand, the simpler fixed arrangement of the braked wheel may be preferred in certain cases, in particular where the ratio of the braking force to the total mass of the vehicle is small.

Coil 85 is mounted on chassis 4 by means of bearings (not shown). It can thus rotate on its axis and is held motionless by the action of cable 88 which balances the resultant action of cables 5 to 8 and 86. Each of the four cables 5 to 8 is attached at one end to coil 85 and at the other end to one of the suspension posts 9. Body 1 is thus suspended from chassis 4. If the radius at which the four cables 5 to 8 are wound on coil 85 is the same, the total torque they exert on the coil is proportional to the mass of the body, irrespective of the load and the position of the load.

To determine the weight of the complete vehicle it is also necessary to determine the weight of the chassis, which is of constant mass. To this end the tension spring 87 exerts on coil 85 a torque which is added to that of cables 5 to 8, whence its designation as the tare spring.

The tension in cable 42 applied to rocking lever 43 (FIG. 4) and thus the jaw clamping force for clamp 13 are therefore proportional to the total mass of the vehicle. Likewise the tension in cable 90 and therefore the braking force on braked wheel 15 are proportional to the total mass of the vehicle.

In this example, coil 85 is subject to the resultant sum of five forces. The number of forces may naturally be different, in particular if the body 1 suspension polygon has more or less sides.

The advantage of this coil-type weighing mechanism, apart from its simplicity, resides in the free choice it permits in terms of the design of the vehicle suspension. The suspension of chassis 4 relative to rails 12 must be relatively stiff, to permit accurate positioning of the clamp relative to the track. On the other hand, passenger comfort calls for a relatively springy suspension. The body may be suspended relative to the chassis in three directions: vertical, lateral, longitudinal. Lateral and longitudinal suspension may be provided by additional coupling devices between the body and chassis (not shown). For vertical suspension, if the elasticity of the cables is not sufficient it is merely necessary to insert in the cables or suspension posts 9 suspension members such as that shown at 99 in FIG. 12, for example. The spring and damping characteristics of these members 99 may be freely selected by the manufacturer. For example, if the vehicle suspension is to be stiffer on the platform side it is merely necessary to fit cables 5 and 6 with suspension units which are stiffer than those fitted to cables 7 and 8.

The weighing mechanism described with reference to FIGS. 12 and 13 permits a force proportional to the total mass of the vehicle to be applied to more than two units, clamps or braked wheels. To this end it is sufficient to provide further rocking levers. Fitting two braked wheels to a vehicle can, for example, facilitate movement of the vehicle in stations by allowing the vehicle to maintain one braked wheel 15 in contact with a drive belt 22, 23 at all times. If the vehicle has more than one clamp, these may be arranged to grip the same cable, as in FIGS. 14 and 15. They may alternatively be arranged to grip different cables which are offset in the track, so as to enable the vehicle to move from one drive cable to another.

Figure 15:
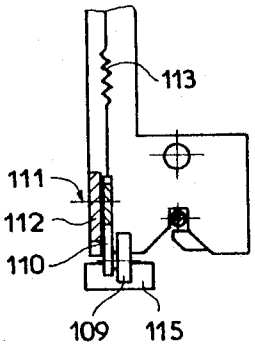
FIG. 15 is a partial cross-section on line XV—XV in FIG. 14.
Figure 14:
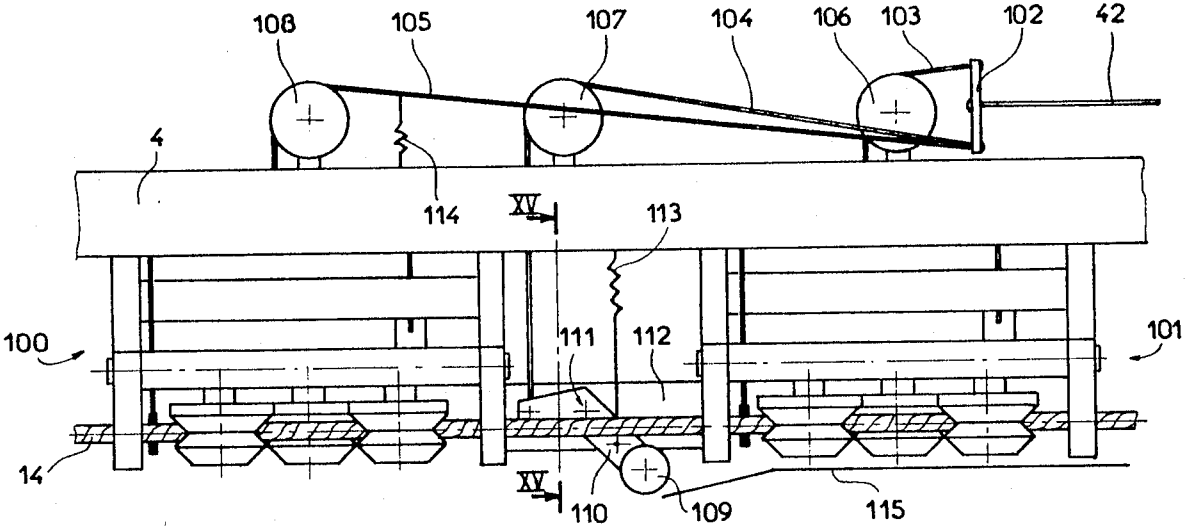
FIG. 14 is a view similar to FIG. 13 showing the mechanism controlling two clamps.

In the embodiment shown in FIGS. 14 and 15, chassis 4 carries two clamps 100 and 101 identical to that shown in FIG. 13. By means of a rocking lever 102, cable 42 acts on cables 103, 104, 105 wound round respective pulleys 106, 107, 108. A roller 109 is mounted on an arm 110 which pivots on a shaft 111 mounted on a plate 112. Springs 113 and 114 represented schematically act on arm 110 and cable 105, respectively.

By virtue of rocking lever 102, cable 42 exerts tension on cables 103 and 105 and therefore a clamping force on clamps 100 and 101. Roller 109 is arranged to co-operate with a cam surface 115 provided on the track. As it passes over this surface roller 109 is lifted, which temporarily cancels the clamping force at clamp 100. The force transmitted by rocking lever 102 is no longer exerted on cable 105, but on cable 104. In this case spring 114 maintains a slight tension in cable 105. Similarly, spring 113 maintains a slight tension in cable 104 when roller 109 is not in contact with the cam surface.

Thus as roller 109 passes over cam surface 115, only clamp 101 may grip the drive cable, and the action of clamp 100 is offset relative to that of clamp 101.

This staged operation of two clamps may be of particular benefit. The force of adhesion between the vehicle and cable may with advantage be increased when the vehicle is moving at the same speed as the cable relative to the force on coupling on, where small speed differences may be made up without acceleration disturbing to passengers. This applies in particular to passenger transport systems featuring a steep slope, i.e., a slope greater than 6%. At the moment of coupling on, one of the clamps grips the cable. The other clamp does not grip the cable until the vehicle has travelled a certain distance such as to guarantee that the cable and vehicle are moving at the same speed.

Furthermore, if each of the clamps is able to entrain the vehicle over the entire route when acting alone, total failure of one clamp will be of no consequence, conferring excellent operational security.

In an alternative arrangement, the clamp which grips the cable second, when the vehicle and cable are moving at the same speed, may be of a conventional type operating instantaneously, rather than of the progressively acting type described herein. A further alternative is to implement staged control by means of a staged device, such as, for example, separate coupling and decoupling cams 20, 21 for the two clamps, arranged on opposite sides of the track.

Figure 16:
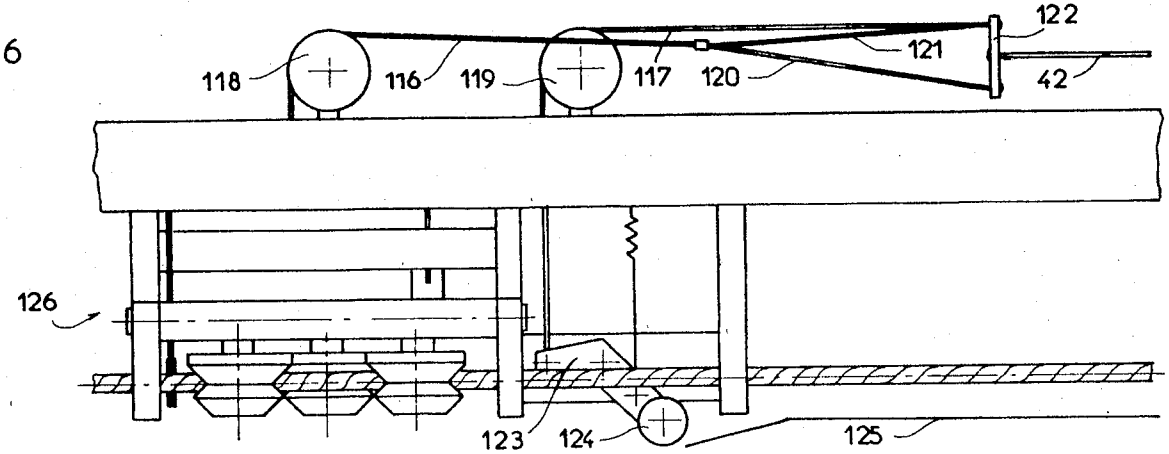
FIG. 16 is a view similar to FIG. 14 showing a clamp control mechanism in which the clamping force is variable.

FIG. 16 is a schematic representation of a mechanism for varying the clamping force where the vehicle is coupled to the cable by a single clamp. The mechanism basically comprises two pulleys 118 and 119 around which are wound two cables 116 and 117. At its right-hand end cable 116 divides to form two cables 120 and 121 which are attached, like cable 117, to a rocking lever 122.

Cable 116 controls operation of a clamp 126. Cable 117 is connected at one end to a rocking lever 122 and at the other end to an arm 123 terminating in a roller 124 which engages a cam surface 125. When arm 123 is not raised by cam surface 125 the tension in cable 42 is distributed between cables 120 and 121 and transmitted in full to cable 116. The clamping force is then maximum. When arm 123 connected to cable 117 is raised by the cam surface, cable 117 removes the load from cable 121 and cable 116 receives only the tension in cable 120. The clamping force is thereby reduced.

As rollers 37, 41 (FIG. 4), 109 (FIG. 14) and 124 (FIG. 16) contact cam surfaces fixed relative to the track, the total force with which the clamps on a vehicle grip the cable under the control of the previously-described mechanism is conditional on the position of the vehicle on the track. Irrespective of the position of the vehicle on the track and irrespective of the load, this total clamping force is proportional to the total mass of the vehicle.

The invention is not limited to the embodiments which have just been described. Modifications may be made thereto without departing from the scope of the invention. For example, in the description of FIGS. 12 and 13 the cables 5 to 8, 86, 88 may be replaced in whole or in part by chains. In this case, the pulleys around which these cables are wound would be replaced by sprockets.

The clamp in accordance with the present invention finds very varied applications in the transport field:

transport of passengers and goods in urban areas, airports, car parks, shopping centres, exhibitions, industrial plant;

transport of ore, offering very high throughputs over unlimited distances thanks to the ease and security of the operations for coupling vehicles to and decoupling them from moving cables;

discontinuous transportation of loads between workstations in semi-automatic industrial plant.

I claim:

1. An automatic transport system comprising:

a plurality of non-motorized vehicles supported for rolling movement on a closed-circuit support and guide track, said track having a main section for high speed movement of said vehicles and a station section adjacent to an end of said main section for decelerating said vehicles, said station section having an entrance and an exit;

a drive cable continuously moving in a closed circuit defined by a set of rollers for pulling said vehicles over said main section of said track, each of said vehicles having automatic coupling means for coupling the said vehicle to said drive cable, said coupling means comprising a two-branch clamp for embracing said cable, each of said branches comprising a fixed member mounted on the chassis of said vehicle, and a revolving member mounted on said fixed member; and means for automatically applying a predetermined clamping force to said cable, at least one branch of said clamp having means for opposing the movement of said revolving member relative to said fixed member with a force proportional to said predetermined clamping force, whereby upon closing said clamp said revolving member rolls without slip relative to said cable and revolves relative to said fixed member, said means for opposing the movement of said revolving member limiting the value of acceleration of said vehicle to a predetermined value so that the vehicle gradually attains the speed of said drive cable;

means located at the entrance to said station section for automatically opening said clamp;

means for automatically decelerating and transporting said vehicles between the entrance and the exit of said station section; and means at the exit from said station section for automatically closing said clamp to attach said vehicles to said cable.

2. The automatic transport system according to claim 1, wherein means are provided at the exit from said station section for bringing said cable into closer proximity with said clamp prior to the automatic closing thereof.

3. The automatic transport system according to claim 2, wherein said means for bringing said cable into closer proximity with said clamp is operative in an area wherein the relative distance between said vehicle support and guide track and said drive cable is varied.

4. The automatic transport system according to claim 1, wherein each of said vehicles comprises weighing means for weighing the load thereof, said weighing means providing an output force, said predetermined clamping force being dependent on said output force.

5. The automatic transport system according to claim 4, wherein said weighing means comprises a mechanism for weighing the body and the load carried thereby, each of said vehicles comprising a spool member freely rotatably mounted on the chassis of the associated vehicle, a plurality of ties suspending the body of the associated vehicle and arranged to rotate the spool member in one direction and another tie transmitting the output force of said weighing means in the opposite direction.

6. The automatic transport system according to claim 5, wherein resilient means are connected to said spool member to urge said spool member in said one direction, the force exerted by said resilient means substantially corresponding to the weight of the chassis of the vehicle.

7. The automatic transport system according to claim 4, wherein actuator means are provided at predetermined locations on the track of said main section operative for reducing the output force produced by said weighing means transmitted to said means for opposing the movement of said revolving member.

8. The automatic transport system according to claim 1, wherein at least one guide is attached to the chassis of each of said vehicles for limiting transverse movements of the cable when entraining the associated vehicle, said guide having a flared inlet, and which further comprises at least one member for closing off said flared inlet when said clamp is closed and which is retracted when said clamp is opened.

9. The automatic transport system according to claim 1, wherein each said vehicle comprises an additional coupling means operative substantially once said vehicle has reached the speed of said drive cable.

10. The automatic transport system according to claim 9, wherein said additional coupling means positively grips said cable when it becomes operative.

11. The automatic transport system according to claim 1, wherein said revolving member comprises an endless belt.

12. The automatic transport system according to claim 1, wherein a conveyor belt is provided for another section of said track, each of said vehicles having a shaft mounted on its chassis, a wheel rotatably mounted on said shaft, said wheel being adapted to be in slipfree rolling contact with said conveyor belt when the associated vehicle is in the other section of said track, and means for opposing rotation of said wheel.

13. The automatic transport system according to claim 12, wherein each of said vehicles comprises weighing means for weighing the load thereof, said weighing means providing an output force dependent on the weight of said load, and means transmitting said output force to said means for opposing rotation of said wheel.

14. The transport system according to claim 1, wherein a conveyor belt is provided for another section of said track, each of said vehicles having a shaft fixed to an arm pivotally mounted on the chassis of the associated vehicle; a wheel rotatably mounted on said shaft for slipfree rolling contact with said conveyor belt when the associated vehicle is in the other section of said track; means for opposing rotation of said wheel; and weighing means for weighing the load of the associated vehicle, said weighing means providing a force dependent on the weight of the load for forcing said wheel against said conveyor belt.

* * * * *